US008118370B2

(12) United States Patent
Portmann et al.

(10) Patent No.: US 8,118,370 B2
(45) Date of Patent: Feb. 21, 2012

(54) MILLING HEAD AND METHOD FOR MACHINING PILE HEADS

(75) Inventors: Alois Portmann, Rain (CH); Hanspeter Marti, Kottwil (CH)

(73) Assignee: Baurent AG Central, Ruswil (CH)

( * ) Notice: Subject to any disclaimer, the term of this patent is extended or adjusted under 35 U.S.C. 154(b) by 163 days.

(21) Appl. No.: 12/449,963

(22) PCT Filed: Apr. 18, 2008

(86) PCT No.: PCT/EP2008/054735

§ 371 (c)(1),
(2), (4) Date: Sep. 4, 2009

(87) PCT Pub. No.: WO2008/135365

PCT Pub. Date: Nov. 13, 2008

(65) Prior Publication Data

US 2010/0109420 A1 May 6, 2010

(30) Foreign Application Priority Data

May 7, 2007 (EP) ..... 07107656

(51) Int. Cl.
*E02D 9/00* (2006.01)

(52) U.S. Cl. ..... 299/41.1; 175/334

(58) Field of Classification Search ..... 299/41.1; 175/333, 334

See application file for complete search history.

(56) References Cited

U.S. PATENT DOCUMENTS

| | | | | |
|---|---|---|---|---|
| 2,783,038 | A * | 2/1957 | Tracy | 299/110 |
| 4,968,101 | A * | 11/1990 | Bossow | 299/41.1 |
| 5,497,841 | A * | 3/1996 | Cox et al. | 175/71 |
| 6,003,953 | A | 12/1999 | Huang et al. | |
| 6,076,895 | A * | 6/2000 | Ino et al. | 299/41.1 |
| 2006/0060386 | A1 | 3/2006 | Reich | |

FOREIGN PATENT DOCUMENTS

| | | | |
|---|---|---|---|
| DE | 966 728 | | 10/1957 |
| DE | 2 136 147 | | 2/1973 |
| DE | 35 41 786 | A1 | 8/1986 |
| DE | 198 27 058 | A1 | 4/1999 |
| DE | 100 41 275 | A1 | 3/2002 |
| EP | 1 093 898 | A2 | 4/2001 |
| EP | 1 640 507 | A1 | 3/2006 |

OTHER PUBLICATIONS

"Spitzen-Technologie, Die Weltweit Wege Weist," Product catalogue of erkat—spezialmaschinen—service—gmbh, www.erkat.de [Date Unknown].

* cited by examiner

*Primary Examiner* — John Kreck
(74) *Attorney, Agent, or Firm* — Oliff & Berridge, PLC

(57) ABSTRACT

The milling head which serves for the machining of the head of a pile consisting of a pile core, a pile shaft and a metal reinforcement lying therebetween comprises a coupling device that can be connected to a drive shaft and a plurality of picks that are used to remove concrete. According to the invention a central milling cutter provided with a plurality of central picks and an annular milling cutter provided with a plurality of annular picks are fixedly coupled with each other and arranged coaxially with the longitudinal axis of the drive shaft. The central picks are arranged within a central circular ring and the annular picks, separated by a middle circular ring, are arranged in an outer circular ring whereby the circular rings lie at least approximately perpendicular to and concentric with the longitudinal axis of the drive shaft. It is possible with the method according to the invention and the milling head to remove the pile core and the pile shaft simultaneously without the reinforcement of the pile lying in the middle circle being damaged.

10 Claims, 6 Drawing Sheets

1, 11, 12
133
131
132
A
13
1232
C
14
x
1231
112
11
113
h1
123
83
80
h2
88
8
E
122
rd1
B, D
82
81
111
121
114
d

MILLING HEAD AND METHOD FOR MACHINING PILE HEADS

The invention relates to a milling head and to a method for machining pile heads according to the introductory clause of claims 1 and 9.

Milling heads for civil engineering are known for example from [1], "SPITZEN-TECHNOLOGIE, DIE WELTWEIT WEGE WEIST", product catalogue of erkat-spezialmaschinen-service-gmbh, www.erkat.de, and from [2], DE 100 41 275 A1.

[1] discloses a device for machining pile heads which comprises a milling head (type erkat 300-2L) fixed to a hydraulic support unit such as an excavator. According to [1] the head of a pile can be machined with this device within 30 minutes.

Piles of this type to be machined which must typically be provided at unstable sites to support a structure are made of concrete which can be pressure loaded and reinforcing iron which can be tension loaded. The dimensions of the piles are selected according to the structure and the site and can vary within a wide range. Typically, piles are used which have a length of 5 to 50 meters and diameters of 0.4 to 2 meters. In order to manufacture the piles, holes are drilled for example in the ground, into which pipes are inserted. The reinforcing iron is inserted into the pipes and the concrete is filled in. Earth material at the bottom end of the pipe is thereby mostly displaced upwards and after completion of the pile is mostly in its head area, which is why the latter does not have the necessary strength. Furthermore, the pile or its head do not normally have the necessary dimensions. Coupling elements needed for the structure may also be absent. The pile head is therefore mostly machined and newly constructed with the required dimensions and the necessary quality.

For this, the pre-manufactured, normally cylindrical pile head, for example as shown in [1], is machined using a milling head typically over a length of 0.4 to 1 meter, in order to remove the defective concrete. The concrete must thereby be removed in such a way that the reinforcing iron typically arranged coaxially with the longitudinal axis of the pile is not damaged. By means of the milling head shown in [1] the pile core is milled out within the reinforcing iron as far as the edge of the reinforcing iron, whereby it depends upon the skill of the excavator driver whether the reinforcing iron is damaged or not. Then, the outer pile shaft adjacent to the iron reinforcement is removed, whereby this is even more difficult by means of the milling head according to [1]. If, on the other hand, the iron reinforcement is damaged, there are consequent strength problems or it is even necessary to refurbish the pile with considerable additional resources. The released original reinforcement must therefore fulfil certain requirements in order that the supplementary reinforcement can be assembled.

After the removal of the concrete and the release of the reinforcement the latter is normally extended by the supplementary reinforcement and provided with a casing which corresponds to the dimensions of the pile head to be newly created. The casing is then filled with concrete and removed once the concrete has set.

With the device described in [1] therefore the machining of the pile head is only possible using great time resources and skill, whereby there is always a considerable risk that the reinforcement will be damaged.

In order to accomplish more complex tasks, a complex system is disclosed in [2] with milling cutters that can be put together as desired, but which is not suitable for machining pile heads.

It is thus an object of the present invention to indicate a method and an improved milling head, by means of which a pile head can be machined more quickly and reliably, in particular without damage to the reinforcement integrated therein.

This object is accomplished with a method and a milling head which have the features indicated in claims 1 and 9. Advantageous embodiments of the invention are indicated in further claims.

The milling head serves for the machining of the head of a pre-manufactured pile lowered into the ground which essentially comprises a cylindrical pile core, a hollow cylindrical pile shaft and a concreted-in metal reinforcement lying therebetween. The milling head provided with picks is connected by means of a coupling device to a drive shaft which can be moved by means of a lifting and drive unit, in particular being lifted and lowered, and can be rotated for the operation of the milling head. An excavator or a cableway with a corresponding driving device is preferably used as the lifting and driving unit.

According to the invention a central milling cutter provided with a plurality of central picks and an annular milling cutter provided with a plurality of annular picks are fixedly coupled with each other and arranged coaxially with the longitudinal axis of the drive shaft. The central picks are arranged within a central circular ring and the annular picks, separated from them by a middle circular ring, are arranged in an outer circular ring whereby the circular rings lie at least approximately perpendicular to and concentric with the longitudinal axis of the drive shaft.

It is possible with the method and the milling head according to the invention to remove segments of the pile core and the pile shaft simultaneously without the reinforcement of the pile lying in the region of the middle circular ring being damaged. The machining is realised with great precision so that the concrete itself can be removed at a small distance of a few centimeters from the reinforcement. The remaining thin concrete sleeve, in which the reinforcement is enclosed can then be quickly removed using a further tool.

It is particularly advantageous that the segments of the pile core and the pile shaft can be removed through linear lowering of the milling head. Complex movements of the milling head which had to be carried out by a skilled worker with a conventional tool are not necessary. The machining of the pile head is thus realised within a few minutes (previously, according to [1], 30 minutes). At the same time, the boring head is evenly loaded, so that more uniform and longer maintenance intervals result.

The central circular ring, within which the central picks of the central milling cutter are arranged is outwardly displaced preferably by 5 cm to 20 cm in relation to the outer circular ring, within which the annular picks are arranged, so that during the machining of a pile head the central milling cutter firstly penetrates linearly into the pile core and the annular milling cutter is subsequently guided correspondingly. As an alternative to this position displacement of the central picks, however, the central milling cutter is additionally preferably provided with a central boring unit arranged coaxially with the longitudinal axis of the drive shaft, which central boring unit projects over the picks and serves for more precise guiding of the milling head during the machining of the pile.

The central picks and the possibly provided central boring unit are arranged on the front side of a shaft preferably provided with a conveying spiral. The annular picks are preferably assembled on an outer assembly ring which is fixedly or detachably connected to an assembly cylinder.

The shaft of the central milling cutter and the assembly cylinder of the annular milling cutter which extend coaxially with the longitudinal axis of the drive shaft and thereby define an at least approximately hollow cylindrical empty volume are connected to the inner side of a coupling plate, on the outer side of which the coupling device which can be connected to the drive shaft is arranged. The coupling device preferably comprises an assembly sleeve with a multi-edged hollow profile, in which the inserted drive shaft can be locked for example using a pin.

The picks provided on the milling cutters which are preferably identical are subjected to a high load during operation and therefore preferably consist of a holder that can be welded or can be mounted in a shape locking way and also a pick element that can be inserted therein and can be routinely replaced. The holders are preferably connected by means of shape locking connections, e.g. dovetail joints, to the associated assembly elements or assembly rings.

In a preferred embodiment the central boring unit can be inserted in the front side of the shaft of the central milling cutter, on the front side end of which the central picks are fixed. The central boring unit can also therefore be easily replaced.

In a further preferred embodiment the central boring unit that can be inserted into the shaft is connected to an inner assembly ring, to which the central picks are fixed. The central picks and the central boring unit can thus be replaced with each other.

The inner and outer diameter of the inner assembly ring and of the outer assembly ring are preferably precisely adapted to the dimensions of the pile and the position of the reinforcement in the pile, so that a maximum removal of concrete is guaranteed and there is minimum risk of damage to the reinforcement.

Insofar as the inner assembly ring and/or the outer assembly ring can be exchanged, the fitting assembly rings can always be put in place to adapt the milling head to the pile to be machined.

In a further preferred embodiment a preferably manually actuated coupling element is provided for example on the coupling plate, in which coupling element the shaft of the central milling cutter can be inserted. It is thus possible to remove the whole central milling cutter from the milling head and to exchange it.

In order to ensure easy and quick exchange of the outer assembly ring, the latter can preferably be connected via flange elements in a shape locking way, preferably by means of a threaded or bayonet fastening, to the assembly cylinder.

The invention is described in greater detail below by reference to the drawings, in which:

FIG. 1 shows the lower side of a milling head 1 according to the invention which comprises a central milling cutter 11 used for machining the pile core 81 and an annular milling cutter 12 used for removing the pile shaft 82;

FIG. 2 shows a partial section through the milling head 1 with the milling elements of the annular milling cutter 12 and the milling and boring elements 111, 114 of the central milling cutter 11 arranged at a distance of h3 below;

FIG. 3 shows the milling head 1 connected via a drive shaft 2 to a lifting and driving device, with the boring and milling elements 111, 114, 121 shown in FIG. 2;

Figure 6:
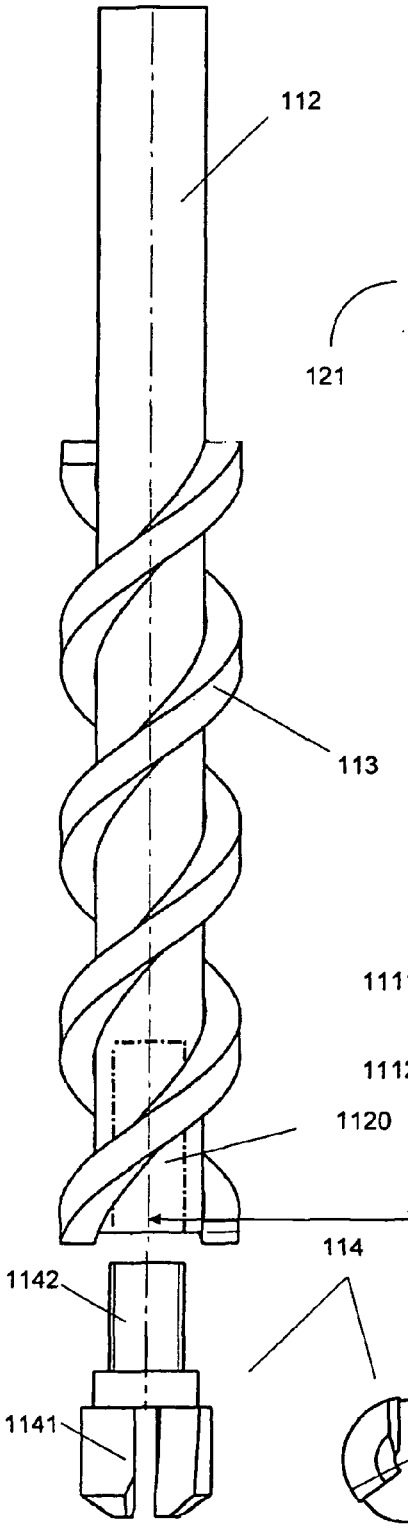
Figure 8:
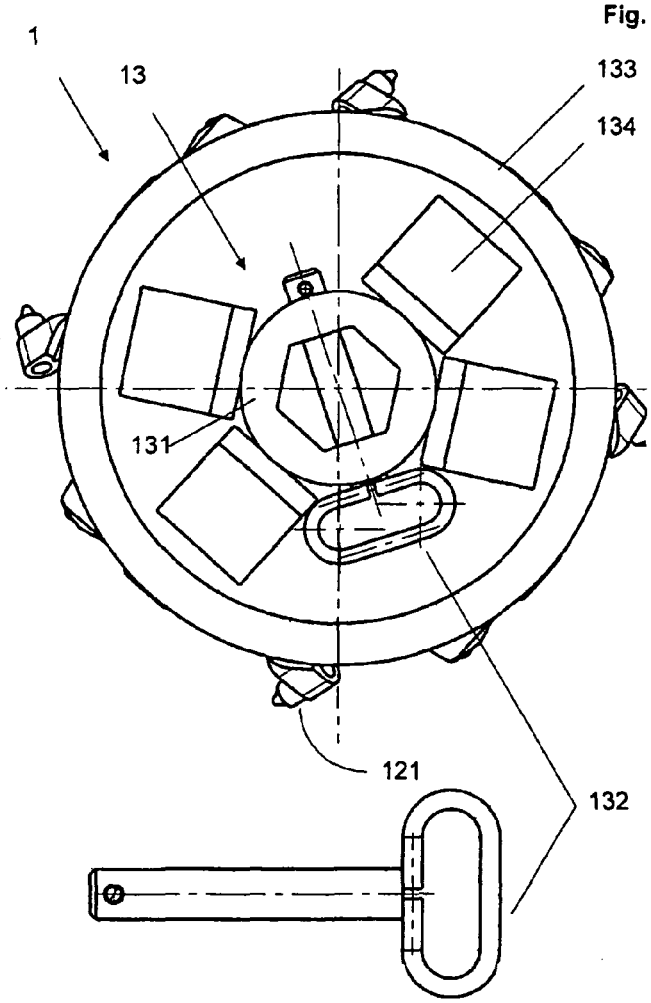
Figure 7:
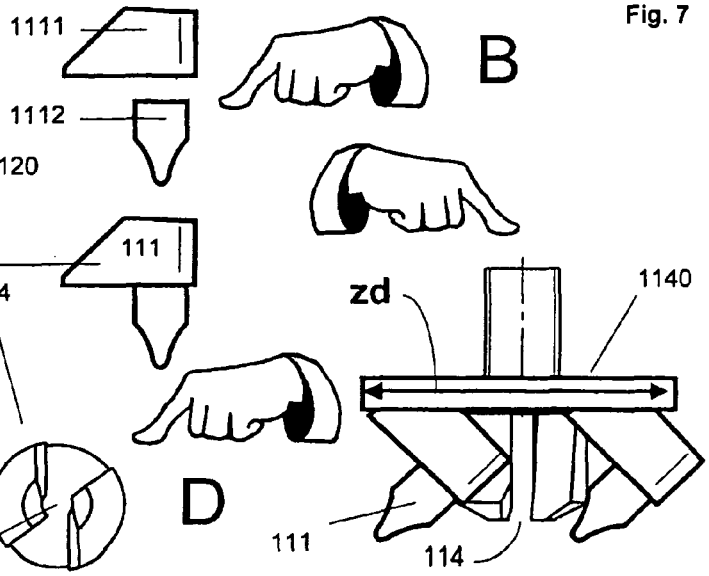
Figure 9:
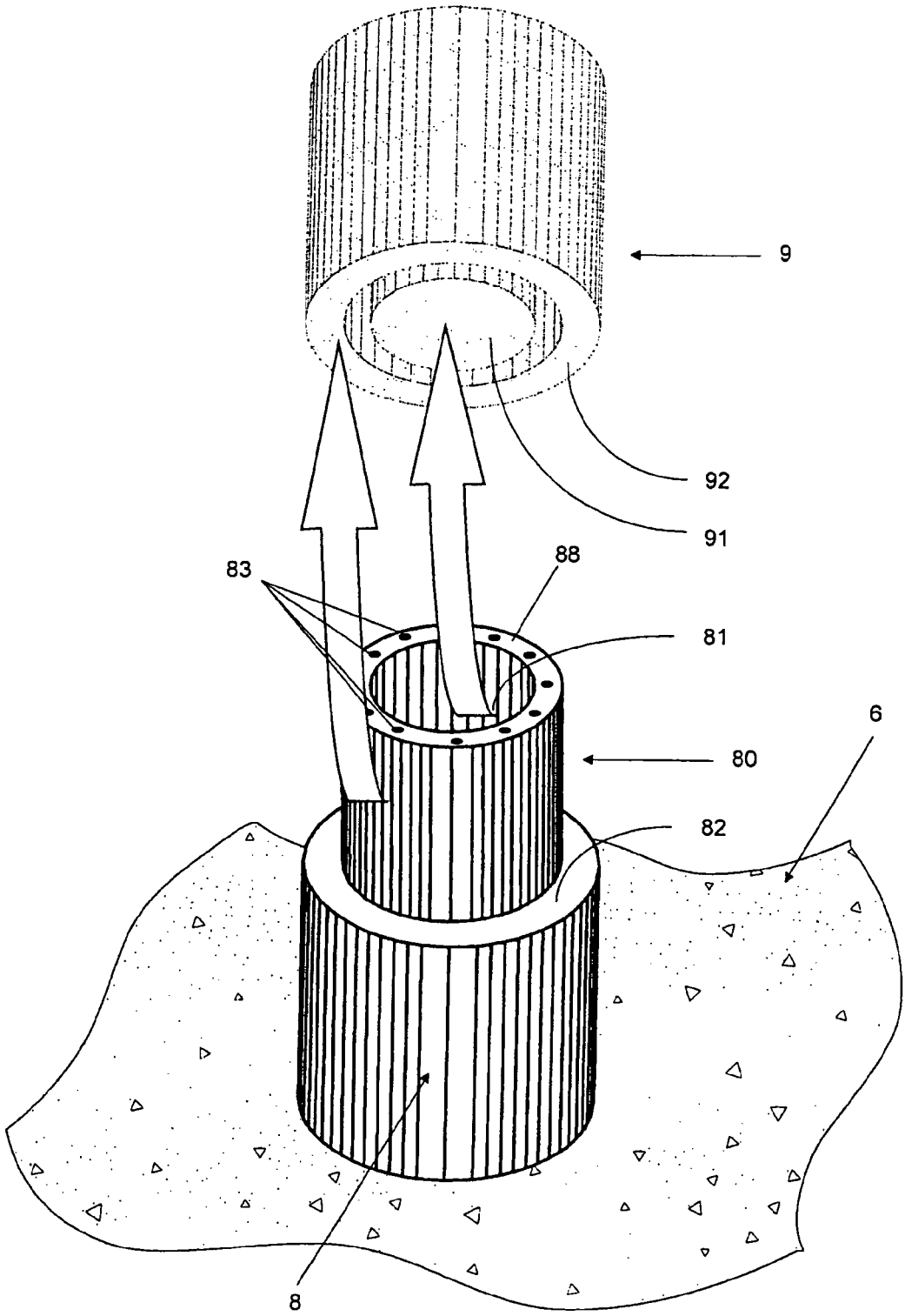

FIG. 6 shows the shaft 112 of the central milling cutter 11 provided with a conveying spiral 113, which is provided on the front side with a central boring unit 114 and central picks 111;

FIG. 7 shows the central boring unit 114 which can be connected to the shaft 112 of FIG. 6 with an assembly plate 1140, on which the central picks 111 are provided;

FIG. 8 shows the milling head 1, seen from above, with a coupling device 13 which consists of a coupling sleeve 131 with a hexagonal hollow profile and a coupling pin 132; and FIG. 9 shows a head 80 of a pile 8 lowered into the ground 6 that has been machined according to the invention and also the material removed in one work step with a vertical movement in the original form.

Figure 1:
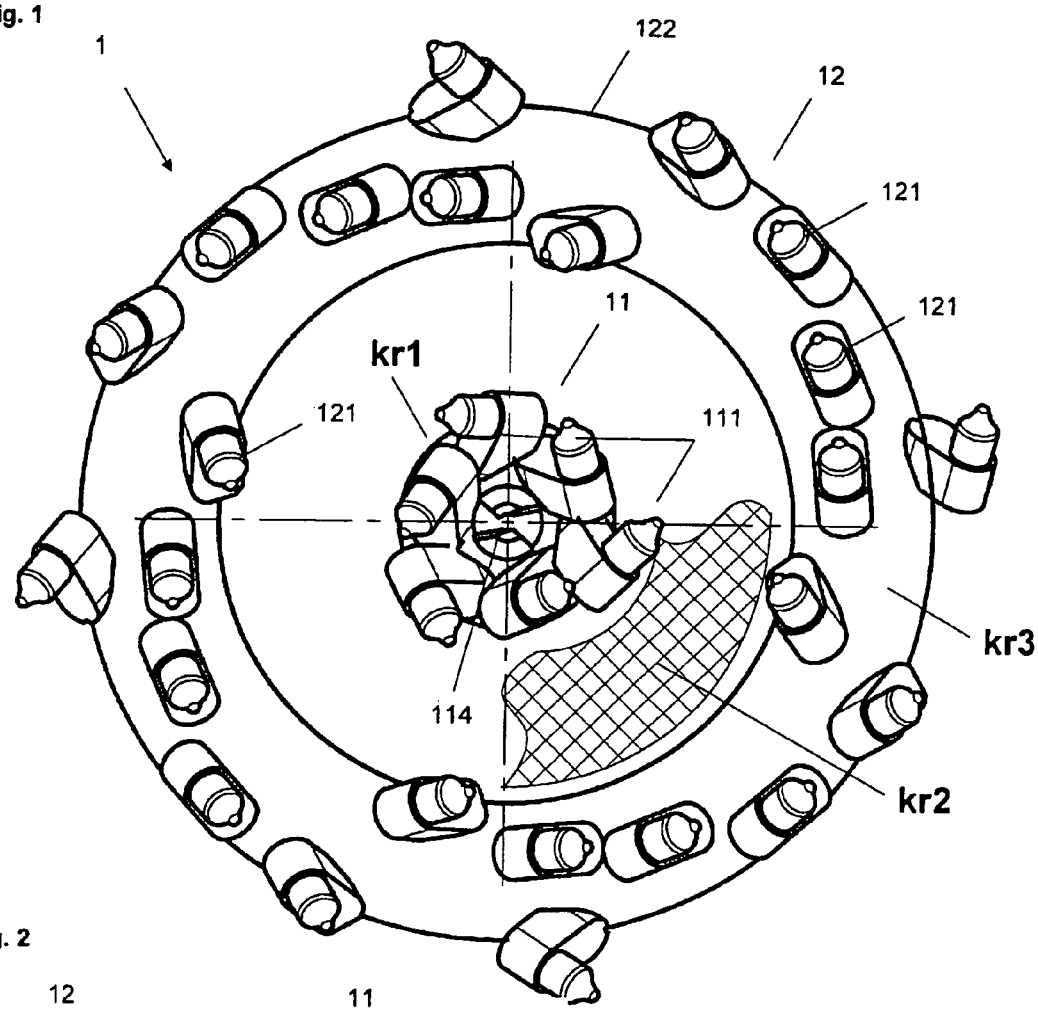

FIG. 1 shows the lower side of a milling head 1 according to the invention which comprises a central milling cutter 11 used for machining the pile core 81 and an annular milling cutter 12 used for removing the pile shaft 82. The central milling cutter 11 has, on its front side, a central boring unit 114 and six central picks 111 which surround the central boring unit 114 in a ring around an inner circular ring krl. The annular milling cutter 12 comprises, on its front side, an assembly ring 122, on which six annular picks 121 are mounted in each of the four quadrants, whereby these are effective within an outer circular ring kr3. A middle circular ring kr2 is kept free between the inner and the outer circular rings krl, kr3, in which middle circular ring kr2 none of the central picks 111 or the annular picks 121 can engage. Upon lowering of the milling head 1 therefore the material to be taken away is removed in one work step, after which only a concrete sleeve 88 provided with the reinforcement 83 remains which corresponds to the middle circular ring kr2.

Figure 2:
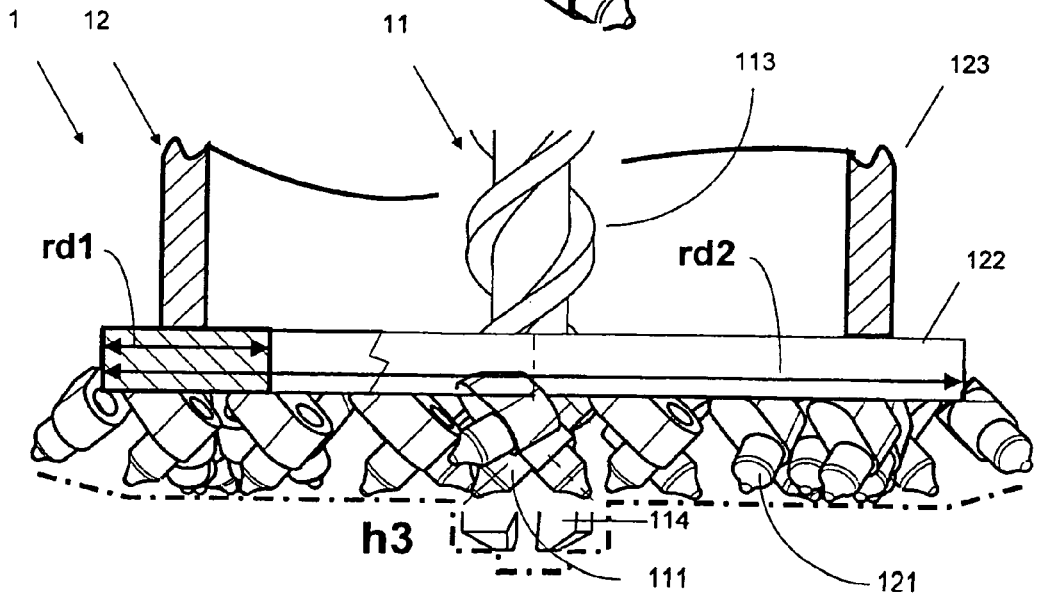

FIG. 2 shows a partial section through the milling head 1 with the milling elements of the annular milling cutter 12 and the milling and boring elements 111, 114 of the central milling cutter 11 lying at a distance h3 below. Upon perpendicular lowering of the milling head 1 onto the head of the pile 8 (see FIG. 5) therefore firstly the central boring unit 114 penetrates therein, whereby the milling head is guided precisely vertically upon further lowering and upon engagement of the picks 111, 121.

Figure 3:
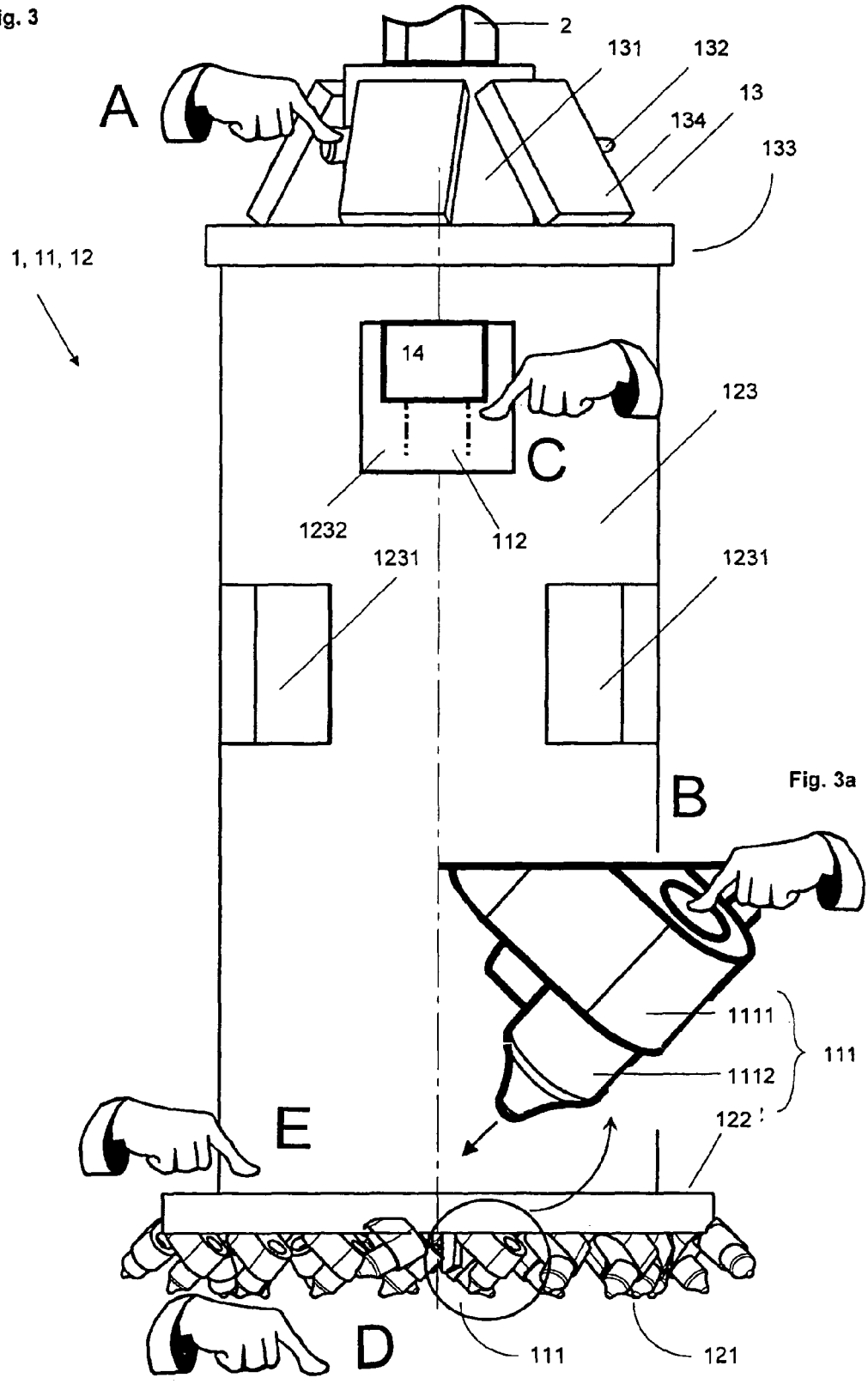

FIG. 3 shows a milling head 1 according to the invention with the boring and milling elements 111, 114, 121 shown in FIG. 2. The assembly ring 122 with the annular picks 121 is connected to the lower side of a hollow assembly cylinder 123 (see also FIG. 2), of which the upper side is connected to a coupling plate 133. The assembly cylinder 123 is further provided with outlet openings 1231, through which the removed material can leave the milling head 1.

A coupling device 13 is fixed to the upper side of the coupling plate 133 (see also FIG. 8) and consists of a coupling sleeve 131 and a coupling pin 132 which can be inserted therein. The coupling sleeve 131 secured by means of optionally provided reinforcement elements 134 comprises a hexagonal hollow profile, into which the correspondingly formed drive shaft 2 can be inserted and locked by means of the coupling pin 132. After the coupling of the drive shaft 2, represented by A in FIG. 3, the milling head 1 can thus be displaced and rotated by means of the lifting and driving device. For this purpose, the drive shaft 2 is connected to a correspondingly equipped excavator (see [1]) or crane.

FIG. 3*a* further shows one of the central picks 121 which consists of a holder 1111 and a pick element 1112, shown enlarged. The pick element 1112 is retained in a force fit in the holder 1111 and can be knocked out and replaced after wear and tear becomes apparent, possibly being restored, as indicated by B. The holders can be welded or assembled preferably by means of shape locking joints, for example dovetail joints, and possibly be secured for example by means of a pin. Shape locking connection techniques are therefore particularly useful, because the milling head is always driven preferably in the same direction. Insofar as the holder is mounted in a shape locking way, it can be removed with a hand grip or using a hammer. The central picks 121 and the annular picks 121 are preferably designed to be identical depending upon the needs of the user.

The assembly cylinder 123 optionally further comprises a window 1232 which allows manual engagement in the milling head 1 in order to activate a coupling unit 14 optionally provided on the lower side of the coupling plate 133, in which coupling unit 14 the shaft 112 of the central milling cutter 11 can be inserted. In this preferred embodiment of the milling head 1 therefore a fitting or a new central milling cutter 11 can be used as a replacement for a worn-out central milling cutter 11, whereby this is represented by C.

D indicates an option that allows boring or milling elements 111, 114 of the central milling cutter 11 to be optionally assembled or dismantled.

E indicates an option that allows the assembly ring 122 provided with the annular picks 121 to be mounted on or dismantled from the assembly cylinder 123.

Options C, D and E which can be provided individually or in combination result in considerable advantages for the production, operation and maintenance of the milling head 1. On account of the exchangeability of the boring and milling tools, the most varied requirements can be met with a basic structure of the milling head 1. Through the choice of the boring and milling tools in the desired dimensions, the milling head 1 can be adapted with few hand grips to the respective structure and the dimensions of the pile 8 to be machined. Through the corresponding choice of the outer diameter rd2 the assembly ring 122 can be adapted to the outer diameter d of the pile 8 (see FIG. 5). Through corresponding choice of the inner diameter rd1 the assembly ring 122 can be adapted to the position of the reinforcement 83 within the pile 8. For adaptation to the core 81 of the pile 8, a fitting central milling cutter 11 is used or a fitting milling ring 1140, 111 (see FIG. 7, diameter zd of the assembly plate 1140) is placed on the shaft 112 of the central milling cutter 11. The milling head 1 can therefore be adapted with few hand grips and without dismantling from the drive unit to the pile 8 to be machined in each case.

It is particularly important to be able to remove the inner and/or outer assembly plate 122 or 1140, also having regard to maintenance and/or down times of the milling head 1. The exchange of the inner and/or outer assembly plate 122/1140, of which the picks are worn out, can be realised within a few minutes so that there are no significant down times. In addition the picks can be more easily repaired or exchanged. Return to the workshop is possible as the milling and boring units can be mounted and stored in a small space.

Figure 4:
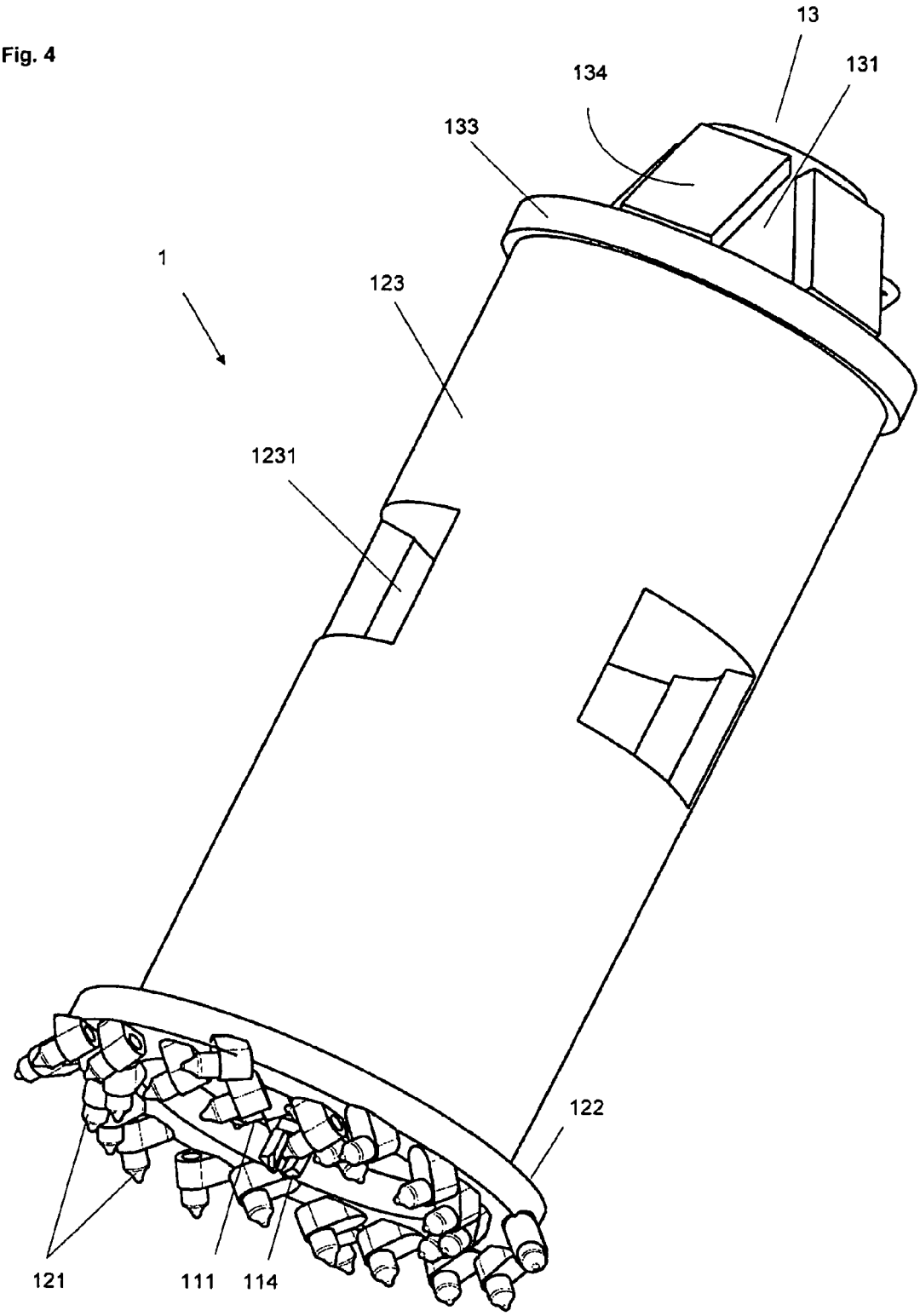
FIG. 4 shows the milling head 1 of FIG. 3 in a three-dimensional illustration.

FIG. 4 shows the milling head 1 of FIG. 3 in a three-dimensional illustration and without a window 1232. In this arrangement the shaft 112 of the central milling cutter is therefore fixedly mounted or screwed in. On the other hand the above-described options D and/or E can be advantageously used.

Figure 5:
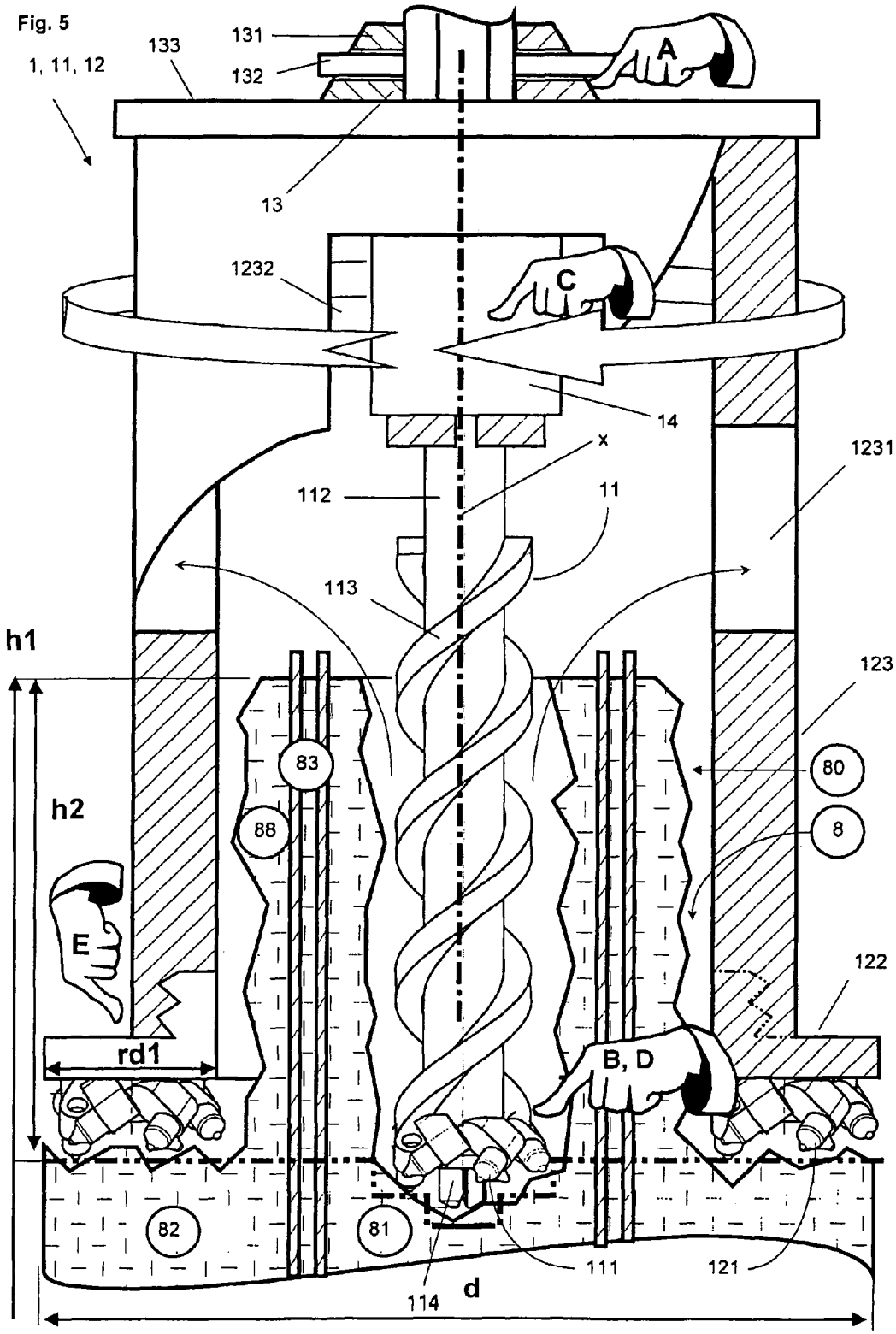
FIG. 5 shows the preferably designed milling head 1 of FIG. 3 shown in sectional representation during machining of a pile 8.

FIG. 5 shows the preferably designed milling head of FIG. 3 shown in sectional representation during the machining of a pile 8 which is shown in a cut open view. The material of the pile head 80 has already been extensively taken out and removed through the outlet openings 1231. The annular milling cutter 12 has removed a segment of the pile shaft 82 and the central milling cutter 11 has removed a somewhat longer segment of the pile core 81. A concrete sleeve 88 remains with the iron reinforcement 83 remaining undamaged in it. The remaining concrete sleeve 88 can subsequently be dealt with using a further tool, such as manually used milling cutters and clamps. It can be seen from FIG. 5 that the pile head 80 has been machined very carefully, which is why the concrete has not quite been removed as far as the reinforcement 83. Through the use of a suitable inner and outer assembly ring (see FIG. 2 and FIG. 7) it is possible on the other hand to additionally remove concrete so that only a thin concrete sleeve 88 remains. It is further shown in FIG. 5 that the outer assembly ring 122 is connected by means of a threaded flange to the assembly cylinder 123 and can thus be easily released (the assembly ring 122 is locked for this purpose and the assembly cylinder 123 is turned by the driving device in the other direction). The central boring unit 114 and/or the central milling ring 1140, 111 is/are preferably constructed and can likewise be dismantled according to FIGS. 6 and 7.

FIG. 6 shows the shaft 112 of the central milling cutter 11, provided with a conveying spiral 113, which has a recess opening 1120 in the front side, into which the connecting pin 1142 of the central boring unit 114 provided on the front side with hard metal blades 1141 can be inserted. Furthermore, the shaft 112 can be connected on the front side to central picks 111. For example their holders 1111 are welded to the shaft 112.

FIG. 7 shows the central boring unit 114 that can be connected to the shaft 112 of FIG. 6, with an assembly plate 1140, on which the central picks 111 forming a milling ring are assembled.

The central boring unit 114 of FIG. 6 or the central boring unit 114 of FIG. 6 provided with the milling ring can therefore be optionally connected to the shaft 112 and removed again.

FIG. 8 shows the milling head 1, seen from above, with the coupling element 13 described above.

FIG. 9 shows a head 80, machined according to the invention, of a pile 8 lowered into the ground 6 and also the material removed in one work step with a vertical movement in the original form, consisting of the removed core segment 91 and the removed shaft segment 92.

LITERATURE

[1] "SPITZEN-TECHNOLOGIE, DIE WELTWEIT WEGE WEIST", Product catalogue of erkat spezialmaschinen-service-gmbh, www.erkat.de

[2] DE 100 41 275 A1

The invention claimed is:

1. Milling head for machining the head of a pile consisting of a pile core, a pile shaft and a metal reinforcement lying therebetween, the milling head comprising:

a coupling device for attaching the milling head to a drive shaft of a drive device;

an annular milling cutter with a hollow assembly cylinder connected to the coupling device;

an outer assembly ring fixedly or detachably connected to a lower side of the hollow assembly cylinder;

a plurality of annular picks attached fixedly or detachably within an outer circular ring on a lower side of an outer assembly ring;

a central milling cutter with a shaft that is aligned along an axis of the hollow assembly cylinder;

a central boring unit and a plurality of central picks attached fixedly or detachably within a central circular ring on a lower side of the central milling cutter, wherein the outer circular ring and the central circular ring, which are separated from one another by a middle circular ring, are aligned at least approximately perpendicular to and concentric with a longitudinal axis of the drive shaft.

2. Milling head according to claim 1, wherein the central circular ring is outwardly displaced in relation to the outer circular ring and/or the central milling cutter is provided with a coaxially arranged central boring unit which projects over the picks and guides the milling head during the machining of the pile.

3. Milling head according to claim 1, wherein the shaft of the central milling cutter is provided with a conveying spiral.

4. Milling head according to claim 3, wherein the shaft of the central milling cutter and the hollow assembly cylinder, which extend coaxially with the longitudinal axis of the drive shaft, are connected to a coupling plate, on which the coupling device is arranged.

5. Milling head according to claim 1, wherein the coupling device comprises a coupling sleeve with a multi-edged hollow profile, in which the inserted drive shaft is locked by means of a pin and/or the identical central and annular picks consist of a holder that is welded or mounted in a shape locking way and also a pick element that is inserted therein.

6. Milling head according to claim 1, wherein the central boring unit is inserted in a front side of the shaft, on a front side end of which the central picks are fixed, or the central boring unit is inserted into the shaft and is connected to an inner assembly ring, on which the central picks are fixed.

7. Milling head according to claim 6, wherein an inner diameter and an outer diameter of the outer assembly ring and an outer diameter of the inner assembly ring are adapted to dimensions of the pile.

8. Milling head according to claim 1, wherein the shaft of the central milling cutter inserted and locked in a coupling element and/or the outer assembly ring connected via flange elements in a shape locking way to the hollow assembly cylinder.

9. Method for machining the head of a pre-manufactured pile which consists of a pile core, a pile shaft and a metal reinforcement lying therebetween, with a milling head according to claim 1, wherein the pile core and the pile shaft of the pile head are simultaneously removed by means of the central milling cutter and the annular milling cutter.

10. Method according to claim 9, wherein the central milling cutter and the annular milling cutter are driven together by means of a drive unit.

* * * * *